United States Patent [19]

Russell

[11] 4,139,977

[45] Feb. 20, 1979

[54] ENVELOPE PROCESSING MACHINE

[75] Inventor: Robert J. Russell, Medford, N.J.

[73] Assignee: Mailex Corporation, Skokie, Ill.

[21] Appl. No.: 860,291

[22] Filed: Dec. 14, 1977

Related U.S. Application Data

[63] Continuation-in-part of Ser. No. 841,007, Oct. 11, 1977, abandoned.

[51] Int. Cl.[2] ..... B65B 57/00; B65B 43/30

[52] U.S. Cl. ..... 53/77; 53/381 R; 250/221

[58] Field of Search ..... 53/77, 381 R; 83/912; 214/304; 250/221, 223

[56] References Cited

U.S. PATENT DOCUMENTS

| | | | |
|---|---|---|---|
| 2,261,431 | 11/1941 | Braun | 250/221 X |
| 2,495,249 | 1/1950 | Gilbert | 250/221 X |
| 3,384,252 | 5/1968 | West | 53/381 R X |
| 3,670,167 | 6/1972 | Forbes | 250/221 |
| 3,979,884 | 9/1976 | Russell | 53/381 R |

*Primary Examiner*—John Sipos

*Attorney, Agent, or Firm*—Edward L. Benno

[57] ABSTRACT

An apparatus for an envelope processing machine in which opened envelopes are serially presented by the machine to a work station in the machine for manual removal of the contents of each serially presented envelope. The apparatus comprises means operating responsive to the hand of a person being moved into and out of a contents removal attitude to a presented envelope to control the serial presentation of envelopes. In a preferred embodiment the apparatus comprises a light source and a photoelectric cell mounted in a spaced apart relationship to each other and to a presented envelope in the machine.

6 Claims, 3 Drawing Figures

L1
L2
L2
300
301
DELAY ADJ.
302
303
307
PHOTO-AMP. RELAY
308
RELAY
309
TIME DELAY RELAY
310
TO CYCLE MACHINE
MS-3
N.C.
N.O.
228

ENVELOPE PROCESSING MACHINE

BACKGROUND OF THE INVENTION

This application is a continuation-in-part application of my pending application filed Oct. 11, 1977, Ser. No. 841,007 now abandoned.

Envelope processing machines which will either slit open one edge of a stack of envelopes or accept a stack of opened envelopes and then serially deliver or present the envelopes to a work station in the machine for manual removal of the contents of the envelopes are known in the art. Generally such machines are operated by electric motors under the control of various switches. Some have switches that permit selection of an automatic mode of operation in which the serial presentation of the envelopes to the work station occurs in a predetermined automatically repeating pattern of presentation involving a rapid movement of each envelope to the work station followed by a holding of the envelope open for a certain period of time to permit a person to remove the contents of the envelope. Some machines also have foot switches that permit a person seated at the machine to operate the foot switch each time the person wants an envelope delivered to the work station. A disadvantage of the automatic mode is that it requires a person to work on each presented envelope in the predetermined alloted time. No matter what the alloted predetermined time interval is, on some occasions it is too long and on others it is too short. A disadvantage of the foot switch is that it requires a person to coordinate hand and foot movements in the operation of the machine.

SUMMARY OF THE INVENTION

As opposed to the known prior art machines, the subject invention comprises an apparatus that essentially is controlled by the hand of a person repeatedly removing the contents of the envelopes. The apparatus provides that when a person removes his hand in completion of an envelope contents removal operation, the next envelope will be presented for contents removal. The apparatus includes an adjustable time delay circuit permitting a person to select just how quickly after he has removed the contents of an envelope that the removed contents envelope will be moved from the work station with the next envelope being moved into the work station.

The time delay feature advantageously permits a person to view the interior of the removed contents envelope before it is moved out of the work station and, if some of the contents were not removed, the person may move his hnd again into the envelope and thereby continue to hold the envelope at the work station. As the person again removes his hand, the time delay cycle is repeated before the envelope is moved out of the work station with the next envelope being advanced therein.

The primary object of the present invention is to provide in an envelope processing machine, a control system that will operate responsive to the movements of the hand of a person in removing the contents of an envelope, which envelope has been presented to a work station in the machine for removal of its contents, to control the operation of the machine for further envelope presentations.

Other objects and features of the invention will be apparent upon a perusal of the detailed description read in conjunction with the drawings.

DETAILED DESCRIPTION OF THE PREFERRED EMBODIMENTS

Figure 1:
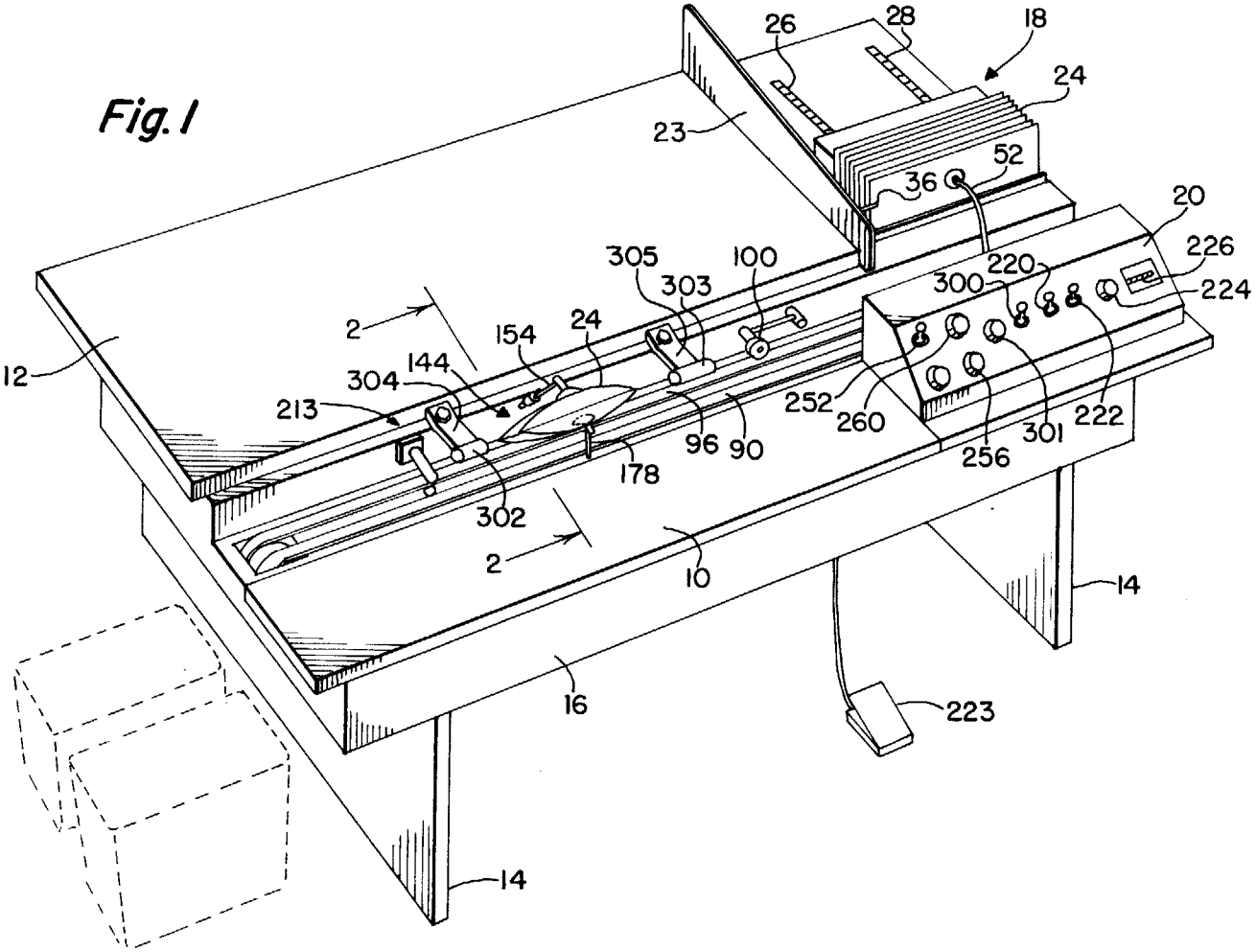
FIG. 1 is an isometric view of a certain envelope processing machine including one embodiment of the present invention.

The certain envelope processing machine of FIG. 1 to which the present invention is applied is shown and described in substantial detail in my copending patent application. Ser. No. 801,454, filed May 31, 1977. In order to concisely describe the present invention a minimum of the machine of my copending application is shown and described herein, and reference to that application is made for a complete understanding of an envelope processing machine to which the present invention is applied in a preferred embodiment. Further, to permit easy reference to the drawings and description of my copending application, the same elements which are shown herein carry the same reference numerals by which those parts are identified in my copending application.

As shown in FIG. 1, the envelope processing machine comprises lower and upper offset table structures 10 and 12 supported at table height by legs 14. The internal mechanisms of the machine are essentially contained within the table structures 10 and 12. The person operating the machine sits facing the lower table structure 10, the front panel of the machine being indicated by the reference numeral 16.

The machine further includes an envelope supply hopper indicated generally by the numeral 18, and the operator control panel for the machine is shown at 20.

The supply hopper 18 includes a number of envelopes 24 from which the operator will manually remove the contents during operation of the machine. The envelopes are aligned in a row against the forward edge of the hopper 18 and are maintained in that position by chains 26 and 28. Side abutment plate 23 aids in aligning the envelopes 24 in the hopper 18. The chains 26 and 28 are driven by a motor (not shown) to urge the envelopes 24 toward the forward edge of the hopper 18. A limit switch having a switch arm 36 controls the operation of the motor for the chains 26 and 28 to move the supply of envelopes forwardly as leading envelopes are removed from the hopper 18.

The leading envelope of the supply of envelopes 24 is removed from the hopper 18 by a pivoting suction arm 52. When the suction arm 52 is operated, the leading envelope is removed from the hopper 18 and the arm 52 moves on an arc downwardly toward the surface of the table 10. Upon reaching the table 10, the arm 52 releases the envelope and deposits it onto belts such as belts 90 and 96 for carrying of the envelope to the work station 144. In an embodiment of the invention of my noted copending application, the arm 52 does not deposit the envelopes directly onto the belts 90 and 96, but onto other belts which are behind the control panel 20 for slitting of one edge of sealed envelopes prior to delivery to the belts 90 and 96. However, for an understanding of the present invention it is not necessary that a cutting or slitting mechanism be described since pre-slit envelopes can be placed in the hopper 18 and the belts 90 and 96 can extend into envelope receiving relation with the arm 52 behind the control panel 20. When such pre-slit envelopes are placed in the hopper 18, the slit edges of the envelopes should be aligned upwardly.

Upon receiving an envelope 24, the machine moves the belts 90 and 96 to carry the envelope to the work station 144, and then stops the belts 90 and 96 with the envelope at the work station 144. The machine then moves the pivoting suction arms 154 and 178 against the opposed sides of the envelope, and a vacuum is drawn at the suction cups 156 and 164, indicated in FIG. 2, of the arms 154 and 178. The machine then moves the arms 154 and 178 upwardly and apart to open the envelope for removal of the contents thereof by the hand of a person as shown in FIG. 2.

Figure 2:
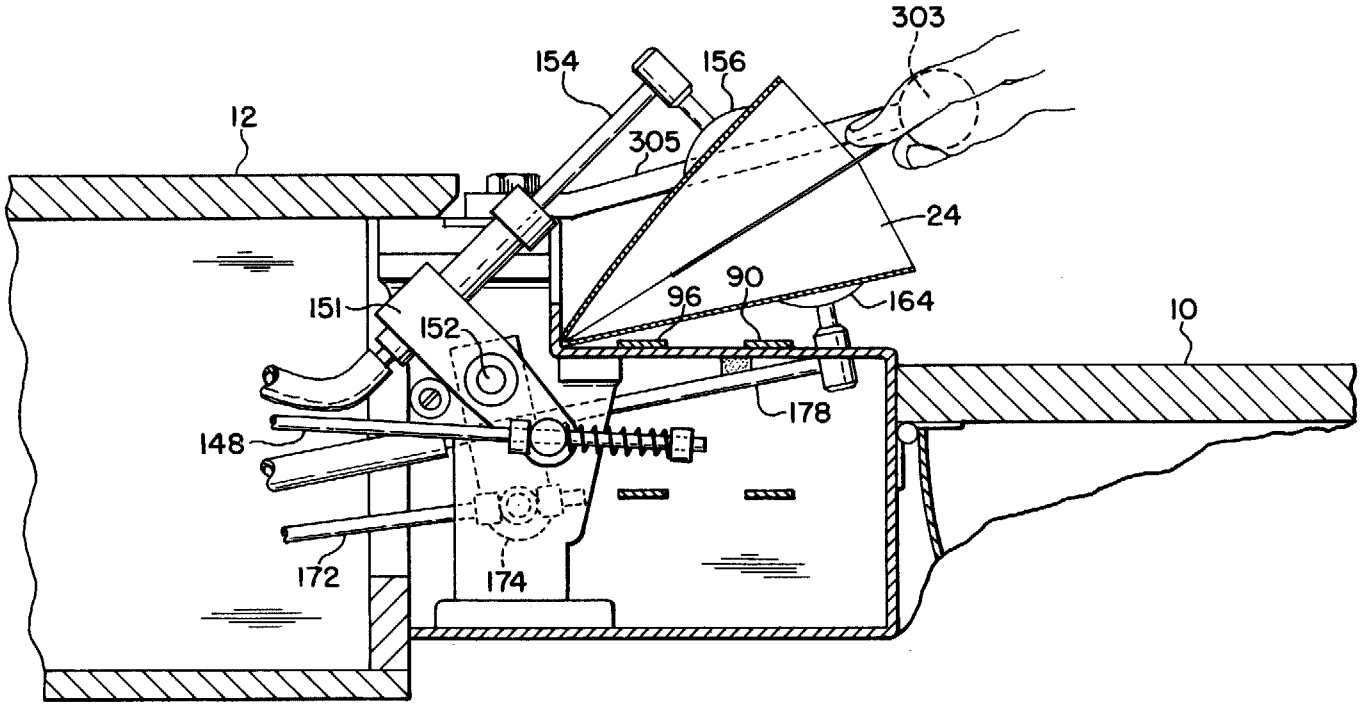
FIG. 2 is an enlarged cross sectional view taken substantially along the line 2—2 of FIG. 1 and showing the hand of a person removing the contents of a presented envelope in the machine.

As further shown in FIG. 2, and as described in detail in my noted copending application, the arm 154 is carried by crank 151 which is pivotally mounted on shaft 152. Crank 151 is pivoted by rod 148 between its lowermost envelope grasping position and its uppermost envelope opening position. Arm 178 is carried on a crank 174 which is also pivotally mounted at shaft 152. Crank 174 is pivoted by rod 172 between its lowermost envelope grasping position and its uppermost envelope opening position.

As further shown in FIG. 1, and as described in detail in my noted copending application, the machine further may include an envelope hold-down roller 100, and a candling mechanism 213 for candling envelopes for missed contents as they leave the work station 144 on the belts 90 and 96. The control panel 20 is shown as including a main on or off switch 220, a manual or automatic mode selector switch 222, a timer control 224 for adjusting the time of each complete cycle in the automatic mode, a cycle counter 226, an on or off switch 252 for the candling mechanism 213, and adjusting controls 256 and 260 for the candling mechanism 213. The machine further includes a foot switch 223 by which the operator can selectively cycle the machine with her foot. With the present invention included and forming a part of the machine, the control panel 20 further includes an on or off switch 300, and an adjustment control 301 for adjusting the length of the time period between withdrawal of the operator's hand from adjacent an envelope 24 in the work station 144 and the operation of the machine on another cycle to deliver another envelope 24 to the work station 144.

The operation of the machine, without the hand control which will be described hereinafter, may occur by two modes, manual or automatic. In the manual mode, the foot switch 223 is momentarily operated. That operation causes the arm 52 to deposit an envelope 24 upon the belts 90 and 96, and the belts 90 and 96 then move the envelope 24 to the work station 144. The suction arms 154 and 178 then grasp the opposed sides of the envelope and pivot and move apart to open and hold the envelope open at an inclined position relative to the horizontal. The envelope 24 is thus presented in the work station 144 for removal of the contents thereof, and the machine will remain in that operated condition until the operator again operates the foot switch 223. Upon further operations of the foot switch 223, envelopes 24 will be released by the arms 154 and 178 as they return to their envelope receiving positions, and the released envelopes will be further carried by the belts 90 and 96 past the candling mechanism 213 and off of the end of the table 10. As described above operations of the foot switch 223 will also serially deliver further envelopes to the work station 144.

In the automatic mode, the operation of the machine is essentially as described above for the manual mode except that no operations of the foot switch are required, and machine will continue to cycle and recycle until it is stopped by operation of the main on or off switch 220. In the automatic mode, the dwell or time interval of each envelope 24 in the presented open, contents removal condition, at the work station 144 is fixed by the adjusted condition of the timer control 224.

Figure 3:
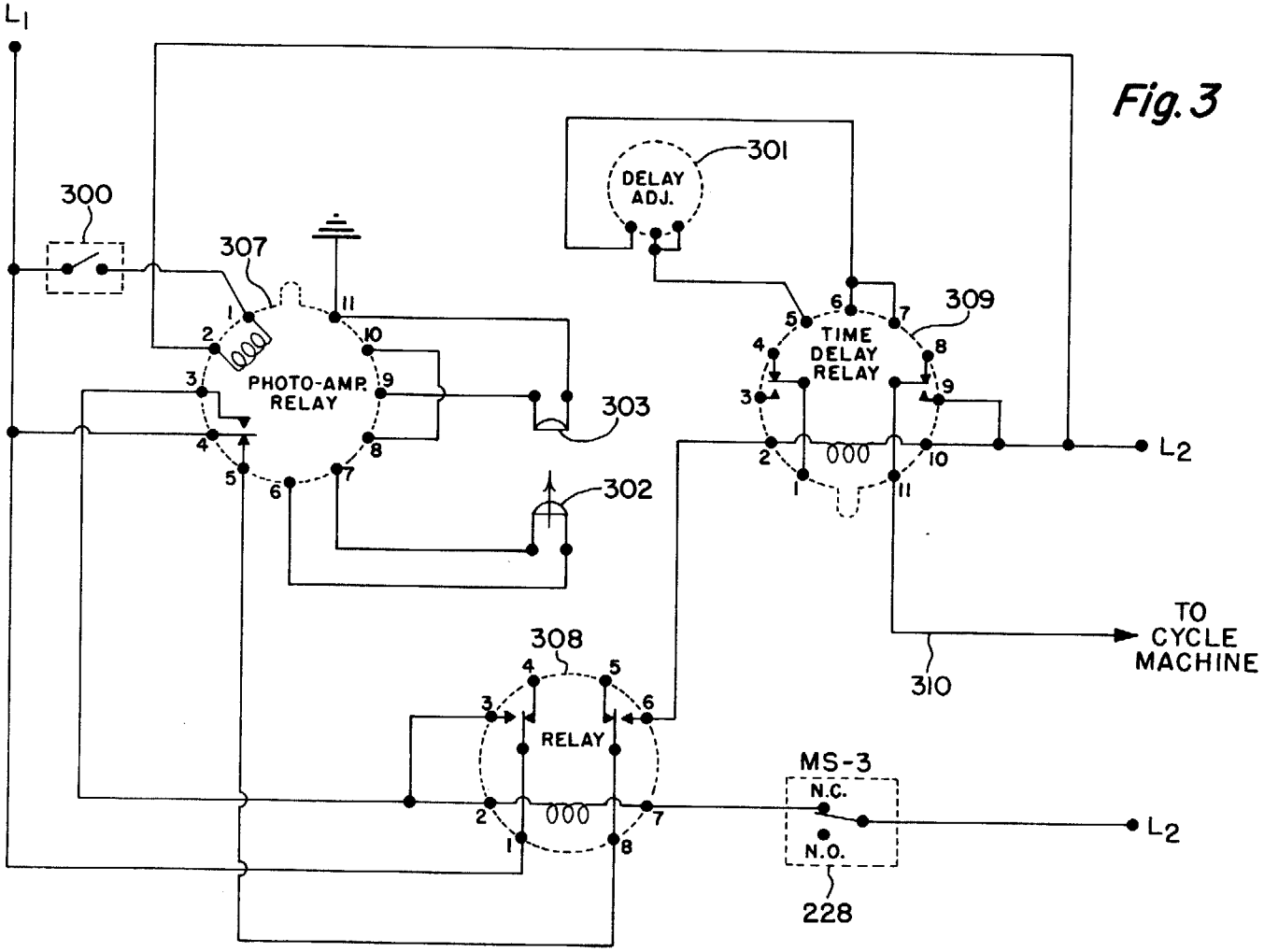
FIG. 3 is an electrical circuit diagram for one embodiment of the invention applied to the certain envelope processing machine of FIG. 1.

The control of the operation of the machine by the operator's hand comprises a light source 302 and a photo-electric cell 303. The light source 302 is secured, and preferably adjustably, down stream of the work station 144 to the forward edge of the table 12 by a bracket 304. The photo-electric cell 303 is secured, and also preferably adjustably, up stream of the work station 144 to the forward edge of the table 12 by a bracket 305. The light source 302 and the photo-electric cell 303 are positioned so that a beam of light from the light source 302 will strike the photo-electric cell 303 on a line that is normally intersected by the operator's hand in an envelope contents removal attitude at the work station 144 such as shown in FIG. 2. The line of the light beam between the light source 302 and the photo-electric cell 303 may further be described as parallel to the belts 90 and 96, and as extending longitudinally centrally of and spaced from the opened side of an envelope being held at the work station 144 by the suction arms 154 and 178 for manual removal of the envelope contents. Those skilled in this art will appreciate that other arrangements for the interruptable light beam may be provided. For example, the light source 302 and the photo-electric cell 303 may be mounted together as a unitary assembly at one of the positions shown for those elements with a reflecting mirror being mounted at the other of the positions shown for those elements. The light source and photo-electric cell are then arranged so that a beam of light from the light source strikes the mirror and is reflected back to the photo-electric cell along paths close to the path described for the embodiment shown. Also, if suitable, other known devices comprising interruptable energy paths or energy fields may be substituted for an interruptable light beam. Whatever arrangement is used, it is essential to the invention that when the operator removes her hand from the area of the opened side of the envelope 24 at the work station 144 in completion of an envelope contents removal operation, the machine will automatically operate to remove the presented envelope 24 and to present the next envelope 24 at the work station 144 in an opened condition for removal of the contents thereof. One preferred embodiment for so controlling the machine described above, and described in greater detail in my noted copending application, is shown in the electric schematic view of FIG. 3.

L1 and L2 are available power lines in the machine, preferably with L1 being the neutral or ground-line. In addition to the main on or off switch 300 and the adjustable time delay resistor 301 which are mounted on the control panel 20, the circuit comprises the light source 302, the photo-electric cell 303, a photo-electric cell amplifier and relay 307, a relay 308, a time delay relay 309, and a limit switch 228.

The limit switch 228 which is also so identified in my noted copending application is mounted in the machine so as to be operated by a cam on the motor which drives the belts 90 and 96. One complete rotation of the motor which drives the belts 90 and 96 produces one feeding of an envelope 24, received from the hopper 18 onto the belts 90 and 96, to the work station 144. The cam on the motor is such that at the initial at rest condition of the motor the normally closed contacts of switch 228 are closed, and during one rotation of the motor the normally closed contacts are opened and the normally open contacts are closed. The power line L2 is connected to the armature of the switch 228 and the normally closed contact is connected to terminal 7 of the relay 308. The coil of relay 308 is connected between terminals 2 and 7 thereof. Relay 308 has relay contents arranged as a double-pole double-throw switch. When relay 308 is deenergized, terminals 1 and 4 and terminals 5 and 8 thereof are closed. Upon energization, terminals 1 and 3 and terminals 6 and 8 are closed.

As the photo-electric amplifier and relay 307 and the time delay relay 309 are well known in the art, those skilled in this art will understand the construction and arrangement of those elements from the schematic diagrams shown. As described relative to relay 308, the operation of the switch contacts of the photo-electric amplifier and relay 307 and the time delay relay 309 are controlled by the energized condition of their coils. When switch 300 is closed, the power lines L1 and L2 are connected across the coil of photo-electric amplifier and relay 307 and the light source 302 is energized. With the light beam from the light source 302 striking the photo-electric cell 303, the relay contacts are operated as shown, terminals 4 and 5 being connected and terminals 3 and 4 being open. Upon interruption of the light beam, terminals 3 and 4 are connected and terminals 4 and 5 disconnected.

Similarly to relay 308, time delay relay 309 has a double-pole double-throw switch contacts arrangement, although for the present embodiment only one switch arrangement is used. When the coil of time delay relay 309 across terminals 2 and 10 thereof, is de-energized, terminals 8 and 11 are connected. Upon energization of the coil of relay 309 and passage of the time period determined by the adjusted condition of resistor 301, terminals 8 and 11 are disconnected and terminals 9 and 11 are connected.

For the description of the present invention it is believed sufficient to point out that upon the connection of terminals 9 and 11 of time delay relay 309, power from line L2 is connected to conductor 310, and conductor 310 is connected to an appropriate terminal in the machine to initiate a cycle of operation of the machine. One cycle of operation of the machine is understood to comprise at least an operation of the pivoting arm 52 to deposit an envelope 24 on the belts 90 and 96, a movement of the belts 90 and 96 to carry the envelope 24 to the work station 144, and an operation of the pivoting arms 154 and 178 to grasp, raise, open and hold the envelope 24 for removal of the contents thereof. With reference to my noted copending application it may be pointed out that conductor 310 is connected to terminal 11 of the time delay relay 240 shown in FIG. 38 thereof to initiate one cycle of operation of that machine.

Upon the foregoing description and with switch 300 closed the operation of the described embodiments begins with the operator's hand breaking the light beam to the photo-electric cell 303. Breaking of the light beam causes terminals 3 and 4 of the photo-electric amplifier and relay 307 to be connected. Line L1 is then connected through terminals 3 and 4 of relay 307, the coil of relay 308, and the normally closed contacts of switch 228 to line L2. Relay 308 then operates connecting its terminals 6 and 8. An obvious holding circuit for maintaining relay 308 operated is completed through the interconnection of terminals 1 and 3 thereof. The connection of terminals 6 and 8 of relay 308 partially completes a circuit for energizing the coil of time delay relay 309. That circuit is incomplete due to terminals 4 and 5 of relay 307 being open. Nothing further will occur until the operator removes her hand to permit the light source 302 to activate the photo-electric cell 303. Upon that occurance, terminals 3 and 4 of relay 307 will be disconnected and terminals 4 and 5 thereof will be connected. Relay 308 will not drop out, and the circuit for energizing the coil of time delay relay 309 will be completed.

If the operator does not again insert her hand into the held envelope during the time period set by the resistor 301, the time delay relay 309 will operate upon completion of the set time period and terminals 9 and 11 of relay 309 will be connected to apply power from line L2 to the machine to initiate another cycle of operation.

If the operator again inserts her hand into the held envelope during the time period set by the resistor 301, terminals 4 and 5 of relay 307 will be disconnected to break the circuit to the coil of time delay relay 309. Thus it may be seen, the time delay period before operation of relay 309 enables the operator to look into the held envelope after she has removed the contents thereof and if she sees that she has overlooked some contents, she can again deactivate the photo-electric cell 303 by breaking the beam from the light source 302 in removing the overlooked contents with her hand. When she thereafter again removes her hand, the photo-electric cell 303 is again activated, relay 307 again connects its terminals 4 and 5, and the coil circuit for time delay relay 309 is again completed. After the predetermined time period, time delay relay 309 will operate to direct power to the machine to start another cycle of operation.

Once the machine begins another cycle of operation, the switch 228 is operated to open its normally closed contacts. That operation of switch 228 breaks the holding circuit for relay 308, and relay 308 restores further breaking its holding circuit at its terminals 3 and 4 and de-energizing the coil circuit of time delay relay 309 at its terminals 6 and 8. It should be understood that the restoration of time delay relay 309 and the disconnection of its terminals 9 and 11 should not affect the operation of the machine through a complete cycle. In other words, once a cycle of machine operation is initiated by a connection of terminals 9 and 11 of time delay relay 309, that cycle must continue to completion even though time delay relay 309 drops out.

As noted previously in the description of the invention as applied to the machine embodiment of my noted copending application, the switch 228 is operated by a cam on the motor for driving the belts 90 and 96. Thus when the belt motor has moved the belts 90 and 96 to deliver another envelope to the work station 144, the belt motor is stopped as the cam on the belt motor breaks the normally open contacts of switch 228 and closes the normally closed contacts thereof.

From the foregoing it can be seen that after each cycle of operation of the machine, and with switch 300 closed, the operator will initiate each succeeding cycle upon removing the contents of an envelope 24 held open at the work station 144, and it is apparent that the machine control provided by her hand is a simple, positive and efficient machine control arrangement.

In the foregoing description, it has been noted that other known devices comprising interruptable energy paths or energy fields may be substituted for the interruptable light beam described in detail relative to one preferred embodiment. Such other devices may for example comprise what is known as a proximity switch which establishes an electrical energy field of capacitive or inductive effect, or both, and which has switch contacts which will be operated responsive to the insertion and removal of a person's hand into and from the established energy field. It should be kept in mind that in using the described interruptable light path or in using any other interruptable energy path or energy field, the arrangement must be such the envelope itself in the work station does not affect the operation of the machine. In other words, it must be the hand of the person at the open side of the presented envelope in the work station that controls the serial or successive presentation of envelopes to the work station and not the envelope itself. As used in the description and claims, those skilled in this art will understand that references to a person's hand can also include anything or on in the person's hand, such as papers or material which the person is holding in the interruptable energy path or field over the open side of the presented envelope in the work station.

In making and using machines embodying the invention care should be taken that the presented envelope in the work station and anything that might be in or on the envelope does not affect the intended control of the machine by the person's hand in removing the contents of or inserting material in the presented envelope. Care should also be taken that false operations of the machine are not caused by the fact that one person may have a smaller hand than another, or that they might hold their fingers in a different manner. Thus in some embodiments of the invention using an interruptable light beam, it may be desireable to adjust the light beam at some angle to the horizontal or vertical over the open side of the presented envelope. In some instances it may be desireable to align the beam in a substantial vertical direction, or to spread or direct its path from a single line into a field or grid over the open side of the presented envelope.

While the described embodiments are primarily directed to envelope processing machines in which a sealed envelope is cut along one edge to open the envelope and the envelope is thereafter presented in a held-open attitude at a work station for manual removal of the contents of the envelope, it should be understood that the invention also contemplates embodiments of envelope processing machines in which empty envelopes are presented in a held-open attitude at a work station in the machine for manual insertion of material into the envelope opes with successive presentations of envelopes to the work station being controlled by a person's hand at the open side of each presented envelope.

Having described the invention, it is to be understood that changes can be made in the described embodiments by one skilled in the art within the spirit and scope of the claims.

I claim:

1. In a machine for handling envelopes including means to serially present envelopes to a work station in the machine for removal of the contents of each envelope when each envelope is in said work station by the hand of a person at said work station, the improvement of control means in said machine operating responsive to an envelope contents removal position of the hand of a person in said work station, including sensing means for sensing the hand of a person at said work station, said control means comprising a first means operating responsive to the removal of said hand from said envelope contents removal position for partially completing a circuit for controlling the operation of said means to present an envelope to said work station, a second means operating from a restored condition after a predetermined period of time for completing said circuit to thereby activate said presenting means and present another envelope to said work station and a third means operating responsive to the reinsertion of said hand in said envelope contents removal position in said work station prior to the passage of said predetermined period of time for restoring said second means to said restored condition without activating said presenting means.

2. In a machine as defined in claim 1, and adjustable means for adjusting said second means to selectively vary the length of said predetermined period of time.

3. In a machine which has a work station accessible to the hand of a person and which includes means to successively present in said work station envelopes which have one open side in an open attitude for manual removal of the contents thereof or for the manual insertion of material therein, the improvement of certain control means for controlling the operation of said machine, said certain control means comprising a first means establishing an energy field over the open side of one of said envelopes in an open attitude in said work station, second circuit means connected to said first means for operating said means to present an envelope in said work station responsive to completion of said second circuit means, a third means operating responsive to said hand of said person being removed from said energy field to partially complete said second circuit means, fourth means operating from a restored condition after a predetermined period of time for completing said second circuit means to thereby activate said presenting means and present another envelope to said work station, and fifth means operating responsive to the reinsertion of said hand of said person in said energy field prior to the passage of said predetermined period of time for restoring said fourth means to said restored condition without activating said presenting means.

4. In a machine as defined in claim 3, and adjustable means for adjusting said fourth means to selectively vary the length of said predetermined period of time.

5. In a machine as defined in claim 3, said first means comprising a light source and a photoelectric cell positioned in said machine to be activated by a beam of light from said light source directed over the open side of one of said envelopes in an open attitude in said work station and deactivated by said hand of said person interrupting said beam of light from said photoelectric cell.

6. In a machine as defined in claim 3 in which said means to present envelopes to said work station includes an electric motor driving a conveyor on which said envelopes are carried, said second circuit means comprising means for connecting power to said electric motor responsive to completion of said second circuit means.

* * * * *